US011358389B2

(12) United States Patent
Shimotsusa et al.

(10) Patent No.: US 11,358,389 B2
(45) Date of Patent: Jun. 14, 2022

(54) ELEMENT SUBSTRATE, LIQUID EJECTION HEAD, AND METHOD OF MANUFACTURING ELEMENT SUBSTRATE

(71) Applicant: CANON KABUSHIKI KAISHA, Tokyo (JP)

(72) Inventors: Mineo Shimotsusa, Machida (JP); Soichiro Nagamochi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/928,907

(22) Filed: Jul. 14, 2020

(65) Prior Publication Data

US 2021/0031513 A1 Feb. 4, 2021

(30) Foreign Application Priority Data

Jul. 30, 2019 (JP) ..... JP2019-140191
Jun. 17, 2020 (JP) ..... JP2020-104702

(51) Int. Cl.
*B41J 2/045* (2006.01)
*B41J 2/14* (2006.01)

(52) U.S. Cl.
CPC ..... *B41J 2/04563* (2013.01); *B41J 2/14129* (2013.01); *B41J 2/14153* (2013.01); *B41J 2202/18* (2013.01)

(58) Field of Classification Search
CPC .. B41J 2/0456; B41J 2/14129; B41J 2/14153; B41J 2202/18
See application file for complete search history.

(56) References Cited

U.S. PATENT DOCUMENTS 10,493,774 B2 * 12/2019 Kanno ..... B41J 2/33535

FOREIGN PATENT DOCUMENTS

JP 2018-24126 A 2/2018

* cited by examiner

*Primary Examiner* — Geoffrey S Mruk
(74) *Attorney, Agent, or Firm* — Canon U.S.A., Inc. I.P. Division

(57) ABSTRACT

An element substrate has a layered structure including a heating resistance element, a first insulation layer where a temperature detection element constituted by a via is formed, and a second insulation layer provided between the heating resistance element and the temperature detection element which electrically insulates the heating resistance element and the temperature detection element.

10 Claims, 6 Drawing Sheets

ELEMENT SUBSTRATE, LIQUID EJECTION HEAD, AND METHOD OF MANUFACTURING ELEMENT SUBSTRATE

FIELD OF THE DISCLOSURE

The present disclosure generally relates to an element substrate that has a heating resistance element, a liquid ejection head that ejects liquid, and a method of manufacturing the element substrate.

DESCRIPTION OF THE RELATED ART

As liquid ejection heads used for liquid ejection printers, liquid ejection heads of a heat ejection type, a piezoelectric element type, and the like are used. A liquid ejection head of the heat ejection type ejects liquid droplets such as ink onto a recording sheet by using heat energy generated by a heating resistance element and forms an image or the like. The liquid ejection head of the heat ejection type is able to generate relatively high heat energy, even when the heating resistance element has a small area, and is thus suitable for dealing with high-density recording. The liquid ejection head has an element substrate that includes the heating resistance element.

These days, the element substrate of the liquid ejection head includes a temperature detection element (temperature sensor) that detects temperature. The temperature detection element is used to acquire information about the temperature, and the heating resistance element is controlled. Japanese Patent Laid-Open No. 2018-24126 describes a configuration including a temperature detection element formed by connecting two wires of layers to each other in series with a via therebetween.

According to the configuration as described in Japanese Patent Laid-Open No. 2018-24126, however, in a temperature detection element that detects a change in temperature on the basis of a change in electrical resistance of a constituent material, the connection resistance of the wires and the via is the dominant resistance, such that sufficient sensitivity may not be achieved. For example, the connection resistance between the wires and the via is large and about 100 to 10000 times higher than the resistance of the materials of the wires and the via, such that it is difficult to detect the change in the resistance of the temperature detection element caused by the change in temperature. Factors of a reduction in the detection sensitivity are, for example, other than the coefficient of temperature resistance of the materials of the wires and the via, a great influence of a change in the resistance between the materials of the wires and the via, high variation between parts, and a great change with time.

SUMMARY

An element substrate of the disclosure has a layered structure including a heating resistance element, a first insulation layer where a temperature detection element constituted by a via is formed, and a second insulation layer provided between the heating resistance element and the temperature detection element which electrically insulates the heating resistance element and the temperature detection element.

Further features of the present disclosure will become apparent from the following description of exemplary embodiments with reference to the attached drawings.

DESCRIPTION OF THE EMBODIMENTS

Embodiments of the disclosure will be described below with reference to the drawings. Note that, in the following description and the drawings, a plurality of drawings may be cross-referenced with each other. Further, common references are applied to equivalent or similar configurations and description thereof will be appropriately omitted.

First Embodiment

Figure 1A:
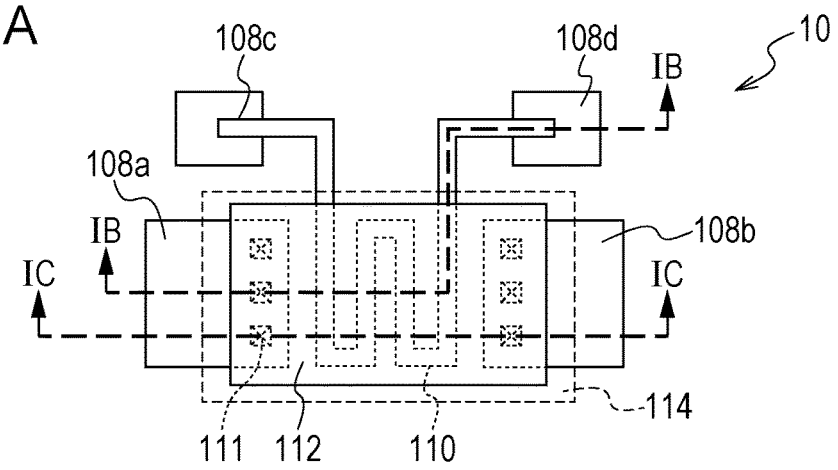
FIGS. 1A to 1C are a plan view and sectional views schematically illustrating an element substrate.
Figure 1B:
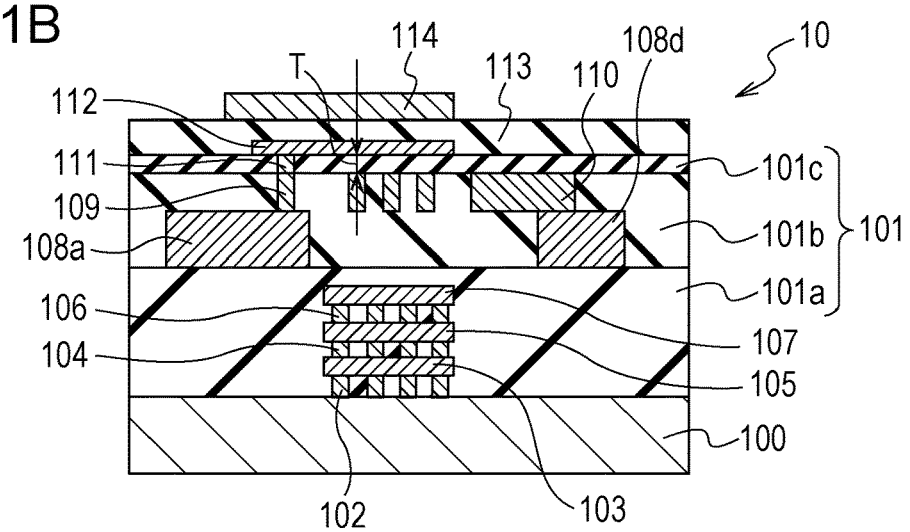
Figure 1C:
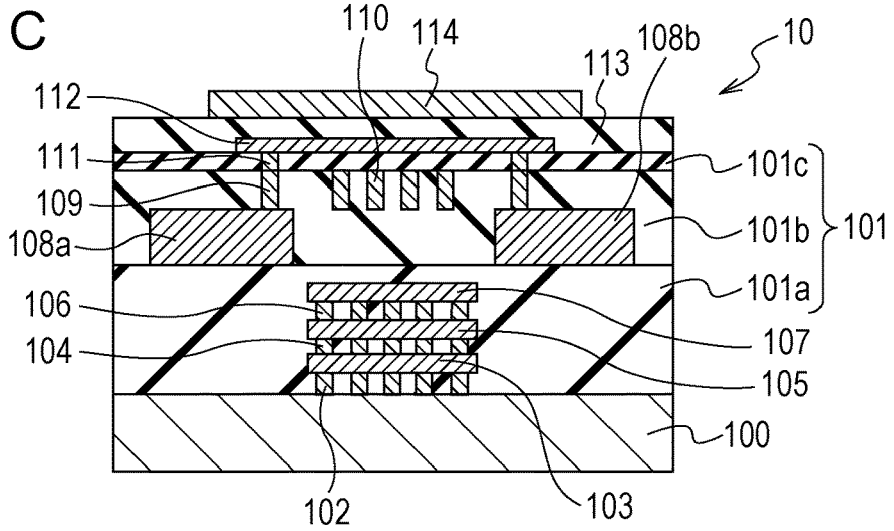
Figure 6:
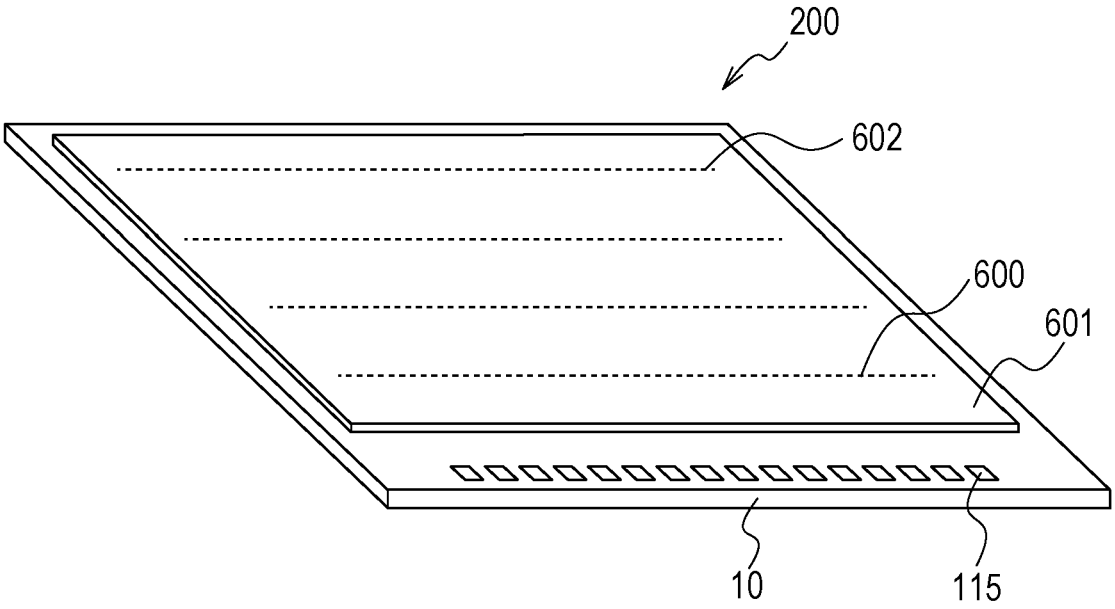
FIG. 6 is a plan view schematically illustrating a liquid ejection head.

A first embodiment will be described with reference to FIGS. 1A to 1C. FIG. 1A is a schematic plan view illustrating a part of an element substrate 10. FIG. 1A illustrates one heating resistance element 112 of a plurality of heating resistance elements 112 provided in the element substrate 10 and a periphery thereof. Note that, to indicate a positional relationship between layers of the element substrate 10, FIG. 1A illustrates a portion of the layers in cutaway. Plan views of the element substrate 10 in the following embodiments are also illustrated similarly to in FIG. 1A. FIG. 1B is a schematic sectional view of the element substrate 10 taken along IB-IB in FIG. 1A. FIG. 1C is a schematic sectional view of the element substrate 10 taken along IC-IC in FIG. 1A. Moreover, FIG. 6 is a schematic plan view illustrating a liquid ejection head 200 including the element substrate 10.

The liquid ejection head 200 includes the element substrate 10 provided with a heating resistance element 112, and an ejection port forming member 601 formed with an ejection port 600 through which liquid is ejected by using heat generated by the heating resistance element 112. A plurality of ejection port arrays 602 in each of which a plurality of ejection ports 600 are arrayed is disposed in the ejection port forming member 601. The heating resistance element 112 and a temperature detection element 110 are formed and arranged in the element substrate 10 so as to correspond to the respective ejection ports 600. An electrode terminal 115 connected to an external wire is provided in a periphery of the element substrate 10.

Next, a configuration of the element substrate 10 will be described. In the present specification, the element substrate 10 has a layered structure in which a plurality of layers are stacked in a layered manner, and in a sectional view such as FIG. 1B, the layering direction in the element substrate 10 coincides with the up-down direction in the figure. For convenience, description will be given by assuming that, in the element substrate 10, a substrate 100 side is a lower side, and a side from which liquid is ejected is an upper side, but the element substrate 10 is not limited to having an up-down orientation.

The element substrate 10 includes the substrate 100 formed of, for example, single-crystal silicon, and an insulation layer 101 is arranged on the substrate 100. The insulation layer 101 is formed of, for example, an inorganic material made of silicon oxide and has an electrical insulation property to electrically isolate respective wires from each other. The insulation layer 101 is formed by stacking a plurality of insulation layers 101*a*, 101*b*, and 101*c* in a layered manner. In the present specification, the respective layers are individually referred to in some cases, and the respective layers are collectively referred to as the insulation layer 101 in other cases. On the substrate 100, for example, connection wires 102, 104, and 106 and signal wires 103, 105, and 107 are arranged to provide a multilayer wiring structure. Thereby, even in a case of a complex circuit configuration, the degree of integration is able to be enhanced without increasing the chip area. The signal wires 103, 105, and 107 are formed of, for example, a metal material having aluminum or copper as a main component. The connection wires 102, 104, and 106 are formed of, for example, a metal material having tungsten or copper as a main component.

A power supply wire 108 is arranged in the insulation layer 101. The power supply wire 108 is patterned and arranged as power supply wires 108*a*, 108*b*, 108*c*, and 108*d*. The power supply wire 108 is formed of, for example, a metal material having aluminum or copper as a main component.

A connection wire 109 and the temperature detection element 110 are arranged on the power supply wire 108. The connection wire 109 and the temperature detection element 110 are electrically connected to the power supply wire 108. The connection wire 109 and the temperature detection element 110 may be made of the same material or may be formed at the same time. The connection wire 109 and the temperature detection element 110 are formed of, for example, a metal material having tungsten, copper, or aluminum as a main component. As described later, the connection wire 109 and the temperature detection element 110 are vias formed in the insulation layer 101*b* in the insulation layer 101. A first via that is the connection wire 109 and a second via that is the temperature detection element 110 are formed at the same position in the layered direction of the respective layers. A connection wire 111 is arranged on the connection wire 109. The connection wire 111 is formed of, for example, a metal material having aluminum or copper as a main component.

Note that, by the temperature detection element 110 performing temperature detection, an ejection state of liquid is able to be detected. More specifically, in accordance with a change in temperature after ejection that varies depending on whether or not liquid is normally ejected, the change in temperature is detected by using the temperature detection element 110. In accordance with a result of the detection, the heating resistance element 112, a recovering unit provided in a printer, or the like is able to be controlled.

An uppermost layer of the insulation layer 101 is flattened. Flattening processing is performed by, for example, CMP (chemical mechanical polishing). The flattening processing may be performed during, after, or both during and after each process of forming the connection wires, the signal wires, the power supply wires, and the temperature detection element.

The heating resistance element 112 is arranged on the uppermost surface of the insulation layer 101. The heating resistance element 112 is electrically connected to the power supply wires 108*a* and 108*b* via the connection wire 111 and the connection wire 109 and functions as a resistance element between the power supply wire 108*a* and the power supply wire 108*b*. The heating resistance element 112 is formed of, for example, a resistance material such as tantalum silicon nitride or tungsten silicon nitride.

A protective layer 113 is arranged on the heating resistance element 112. The protective layer 113 is formed of, for example, an inorganic material containing silicon nitride and has an electrical insulation property. An anti-cavitation layer 114 is arranged on the protective layer 113. In the anti-cavitation layer 114, a high-melting point metal, such as tantalum or iridium, which has excellent heat resistance is formed in a single-layer manner or a stacked-layer manner. The anti-cavitation layer 114 is formed with a thickness of, for example, 30 to 250 nm. The protective layer 113 is formed with a thickness of, for example, 50 to 200 nm and insulates the heating resistance element 112 and the anti-cavitation layer 114.

The signal wires 103, 105, and 107 are formed with a thickness of, for example, 100 to 400 nm. The power supply wire 108 including the power supply wires 108*a* and 108*b* that supply power for driving the heating resistance element 112 is formed with a thickness of, for example, 500 to 2000 nm. The lower limit of thickness of each of the connection wires is decided in accordance with the thickness of the lower wire. That is, since the lower limit of thickness of the insulation layer 101 provided on the respective wires is decided in accordance with the thickness of the wires, the lower limit of thickness of the connection wire passing through the insulation layer 101 is also decided in accordance with the thickness of the lower wire. Accordingly, the connection wires 102, 104, and 106 provided on the signal wires 103 and 105 and the like are formed with a thickness of, for example, 100 to 400 nm. Moreover, the connection wire 109 and the temperature detection element 110 that are provided on the power supply wire 108 are formed with a thickness of, for example, 500 to 2000 nm.

The temperature detection element 110 is electrically connected to the power supply wires 108*c* and 108*d* and functions as a temperature detection sensor between the power supply wire 108*c* and the power supply wire 108*d*. As described above, the element substrate 10 includes a plurality of segments in each of which the temperature detection element 110 is provided below the heating resistance element 112 with the insulation layer 101 (101*c*) in between.

For the temperature detection element 110 to detect an ejection state of liquid by using heat generated by the heating resistance element 112, the heating resistance element 112 and the temperature detection element 110 are preferably provided so as to at least partially overlap each other in plan view of the element substrate 10 (FIG. 1A). Moreover, by increasing the resistance of the temperature detection element 110 in a region where the temperature detection element 110 overlaps the heating resistance element 112, the temperature detection sensor is able to have enhanced sensitivity. Therefore, it is preferable that the temperature detection element 110 have a meandering shape arranged so as to be folded multiple times and have increased resistance. Further, as described later, since the present embodiment uses the temperature detection element 110 formed only of the via that is not connected to a conductor such as another wire, a margin for a connection with the wire does not need to be provided, and accordingly the width of the temperature detection element 110 is able to be reduced and the resistance thereof is able to be increased.

FIGS. 2A to 2G are schematic sectional views illustrating a method of manufacturing the element substrate 10 illustrated in FIGS. 1A to 1C. The method of manufacturing the element substrate 10 will be described below in order of steps with reference to FIGS. 2A to 2G.

Figure 2A:
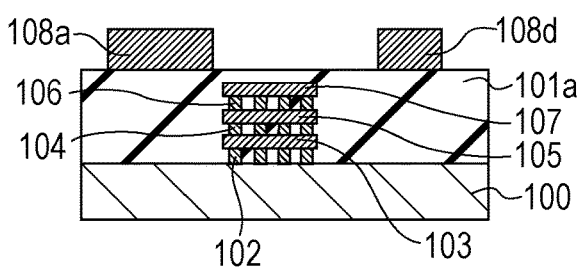
FIGS. 2A to 2G are sectional views schematically illustrating a method of manufacturing the element substrate.

First, as illustrated in FIG. 2A, the connection wires 102, 104, and 106, the signal wires 103, 105, and 107, the insulation layer 101*a*, and the power supply wire 108 (108*a* to 108*d*) are formed on the substrate 100 formed of the single-crystal silicon. For forming the wires and the layer, a CVD (chemical vapor deposition) method, a photolithography method, an etching method, a sputtering method, a plating method, a CMP method, and the like, which are known semiconductor manufacturing techniques, are able to be used. The power supply wire 108 is formed in such a manner that a film of a metal material forming the power supply wire 108 is formed on a surface of the insulation layer 101*a*, a resist pattern is formed thereon by a photolithography method, and the resultant is partially removed by an etching method.

Figure 2B:
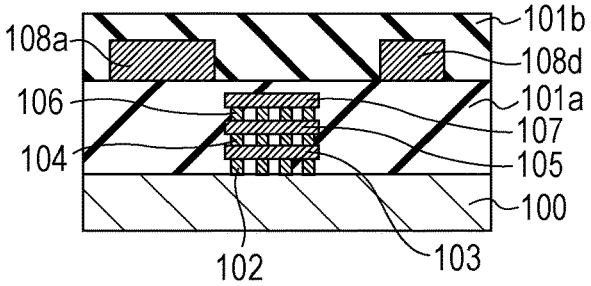

Next, as illustrated in FIG. 2B, a film of silicon oxide is formed by CVD and a surface thereof is flattened by CMP to form the insulation layer 101*b* (first insulation layer).

Figure 2C:
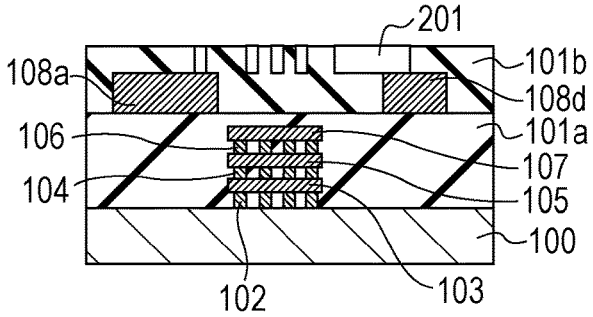

Next, as illustrated in FIG. 2C, a photoresist is patterned, the insulation layer 101*b* is subjected to etching, and a hole 201 is formed. The hole 201 is, to expose a surface of the power supply wire 108 from the insulation layer 101*b*, a through hole that passes through the insulation layer 101*b* or a depression formed on the surface of the insulation layer 101*b*. FIGS. 2A to 2C also illustrate steps of preparing the substrate 100 including the insulation layer 101 on which at least the depression or the through hole is formed.

Figure 2D:
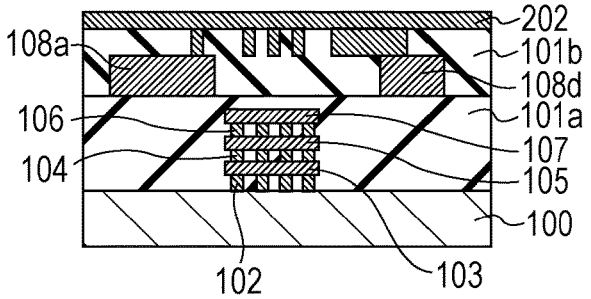

Next, as illustrated in FIG. 2D, a film of tungsten is formed by CVD so as to fill the hole 201, and a film 202 is formed. Otherwise, a film of aluminum is formed by CVD so as to fill the hole 201, and the film 202 is formed. Otherwise, copper is plated so as to fill the hole 201, and the film 202 is formed. As needed, before filling, a film of a barrier metal or a film of a seed layer may be formed by sputtering.

Figure 2E:
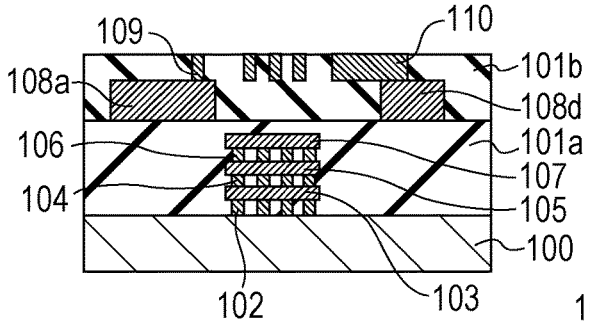

Next, as illustrated in FIG. 2E, by performing flattening while removing unnecessary tungsten, aluminum, or copper by CMP, the connection wire 109 and the temperature detection element 110 are formed. In this manner, the temperature detection element 110 is formed only of a wire, that is, a via by which inter-layer wires are connected and which is formed by forming a hole or depression in the insulation layer, filling the hole or depression with a metal material, and flattening the surface while removing the unnecessary metal material on the surface. Note that, the temperature detection element 110 formed as described above is formed so that the surface thereof and the surface of the insulation layer 101*b* are flat surfaces. Similarly to the temperature detection element 110, the connection wire 109 is also the via formed as described above. Note that, unless particularly described in the present specification, as a similar configuration, a connection wire other than the connection wire 109 is also able to be formed by using a similar manufacturing method to that of the connection wire 109.

Figure 2F:
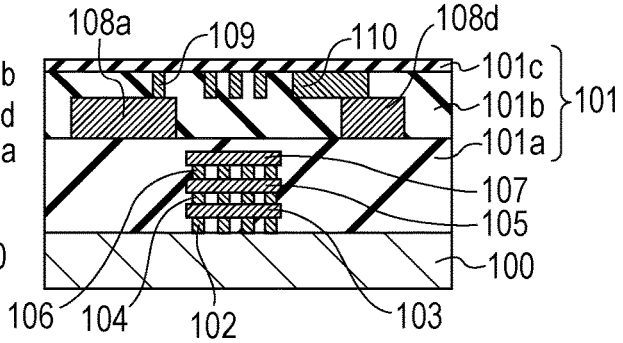

Next, as illustrated in FIG. 2F, the insulation layer 101*c* (second insulation layer) that covers the surface of the insulation layer 101*b*, which is flattened through the film formation of oxide silicon by CVD, and the temperature detection element 110 is formed. The insulation layer 101*c* has a function of electrically insulating the temperature detection element 110 and the heating resistance element 112 which is formed in a later step. The surface of the insulation layer 101*c* may be flattened by CMP, which is not essential because the surface in the state illustrated in FIG. 2E is flattened.

Figure 2G:
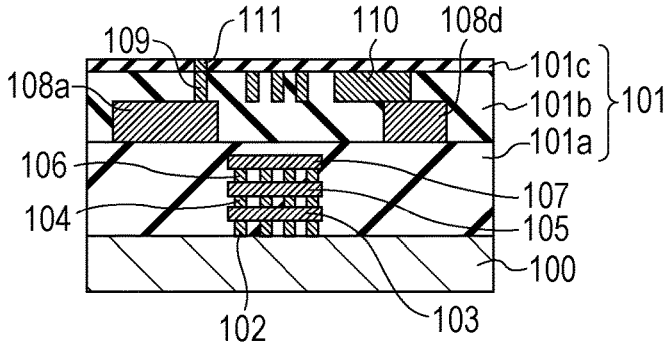

Next, to form the connection wire 111 as illustrated in FIG. 2G, a hole is formed in the insulation layer 101*c*, a film of tungsten is formed by CVD so as to fill the hole, and the resultant is flattened while removing unnecessary tungsten by CMP.

Next, a film of tantalum silicon nitride is formed on the insulation layer 101*c* by sputtering and patterned to form the heating resistance element 112. Further, a film of nitride silicon is formed by CVD, and the protective layer 113 is formed. Further, a film of tantalum is formed by sputtering and patterned to form the anti-cavitation layer 114. In this manner, the element substrate 10 illustrated in FIGS. 1A to 1C is formed.

As described above, in the present embodiment, the temperature detection element 110 constituted by the via is provided in a structure where the temperature detection element 110 is provided below the heating resistance element 112 with the insulation layer 101 in between. The temperature detection element 110 is formed by filling the depression or the through hole provided in the insulation layer 101 (insulation layer 101*b*) with a metal material and flattening the surfaces thereof. Therefore, after the temperature detection element 110 is formed, the surface thereof (surface on a side of the heating resistance element 112) has no difference in level and is flat. This makes it possible to reduce thickness T (FIG. 1B) of the insulation layer 101*c* between the heating resistance element 112 and the temperature detection element 110. When shortening the distance to a heat acting portion that directly transfers heat generated by the heating resistance element 112 to liquid, the temperature detection element 110 is able to have enhanced detection sensitivity to the temperature of the heat acting portion that is used to detect an ejection state of the liquid. In the present embodiment, a surface (surface opposite to a surface facing the heating resistance element 112) of the anti-cavitation layer 114 that contacts the liquid functions as the heat acting portion. Thus, when the thickness T of the insulation layer 101*c* is reduced, the distance to the heat acting portion is shortened, and accordingly the sensitivity of the temperature detection element 110 is able to be enhanced. Accordingly, the present embodiment is able to provide the element substrate 10 that enables temperature detection sensitivity of the temperature detection element 110 to be enhanced.

Moreover, in the temperature detection element 110 constituted by the via, a connection portion with a conductor such as another wire or via is not formed in a region where the temperature detection element 110 overlaps at least the heating resistance element 112. In other words, the temperature detection element 110 is formed as a single via in the region where the temperature detection element 110 overlaps at least the heating resistance element 112. Thereby, there is no influence of connection resistance between a wire and a via, and a change in the resistance of a constituent material of the temperature detection element 110 caused by a change in temperature is easily detected. That is, the change in the resistance of the temperature detection element 110 is able to be made almost equal to the change in temperature. This makes it possible to provide the element substrate 10 that enables the sensitivity of temperature detection by the temperature detection element 110 to be enhanced.

Second Embodiment

Figure 3A:
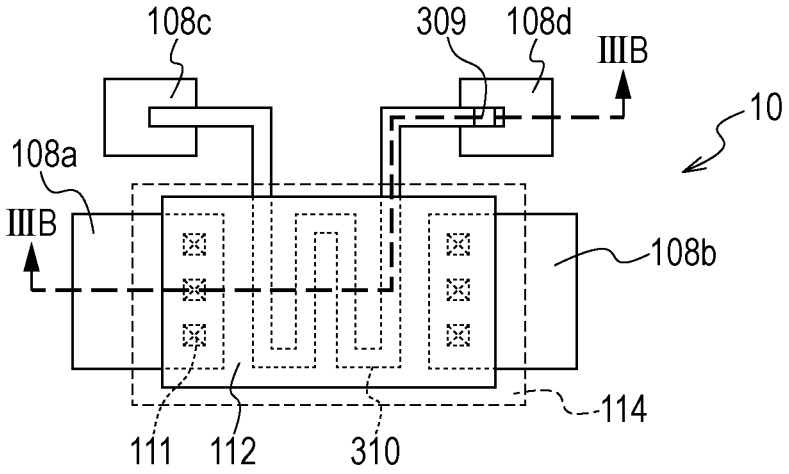
FIGS. 3A and 3B are a plan view and a sectional view schematically illustrating the element substrate.
Figure 3B:
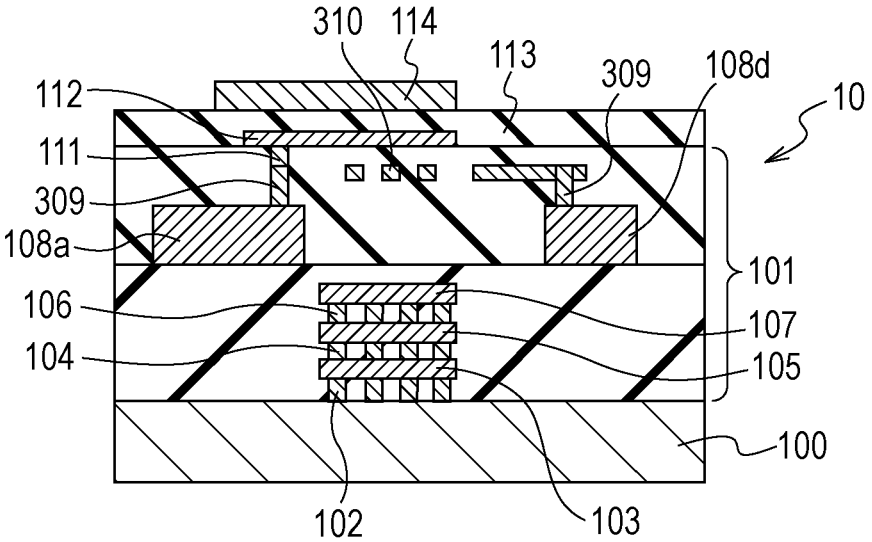

A second embodiment will be described with reference to FIGS. 3A and 3B. FIG. 3A is a schematic plan view illustrating a part of the element substrate 10. FIG. 3B is a schematic sectional view of the element substrate 10 taken along IIIB-IIIB in FIG. 3A. In the second embodiment, an example of a mode in which sensitivity is further enhanced by reducing the thickness of a temperature detection element will be described.

Similarly to the first embodiment, the substrate 100, the insulation layer 101, the connection wires 102, 104, 106, and 111, the signal wires 103, 105, and 107, the power supply wire 108, the heating resistance element 112, the protective layer 113, and the anti-cavitation layer 114 are arranged.

A connection wire 309 is arranged on the power supply wire 108. The connection wire 309 is electrically connected to the power supply wire 108. The connection wire 309 is formed of, for example, a metal material having tungsten or copper as a main component. A temperature detection element 310 is arranged on the connection wire 309. The temperature detection element 310 is electrically connected to the power supply wire 108 via the connection wire 309 that is a via different from a via constituting the temperature detection element 310. The temperature detection element 310 is formed of, for example, a metal material having tungsten, copper, or aluminum as a main component. The connection wire 309 and the temperature detection element 310 are formed in different steps. Note that, the connection wire 309 and the temperature detection element 310 may be formed by partially using a common step as long as a step in which at least the thickness of each of them is defined is performed separately. Therefore, the thickness of the temperature detection element 310 is able to be set to be thin without depending on the thickness of the power supply wire 108. Here, since a high current flows through the power supply wire 108 (108*a*, 108*b*) that supplies power for driving the heating resistance element 112, the thickness of the power supply wire 108 is thick and, for example, 500 to 2000 nm to achieve low resistance and predetermined current density or less. Further, for reliable coverage of the power supply wire 108, the insulation layer 101*b* that covers the power supply wire 108 also needs to have sufficient thickness. The temperature detection element 110 of the first embodiment has a thickness corresponding to the thickness of a part on the power supply wire 108 in the insulation layer 101*b*. On the other hand, the temperature detection element 310 of the present embodiment is able to have reduced thickness compared to the thickness of the part positioned on the power supply wire 108 in the insulation layer 101*b*. That is, the thickness of the temperature detection element 310 of the present embodiment is able to be thinner than that of the temperature detection element 110 of the first embodiment. Note that, the temperature detection element 310 is able to be formed by using the manufacturing method described in the first embodiment.

As described above, according to the element substrate 10 of the second embodiment, the thickness of the temperature detection element 310 is able to be reduced and the resistance thereof is able to be further increased, and accordingly the element substrate 10 that enables sensitivity of temperature detection to be further enhanced is able to be provided.

Third Embodiment

Figure 4A:
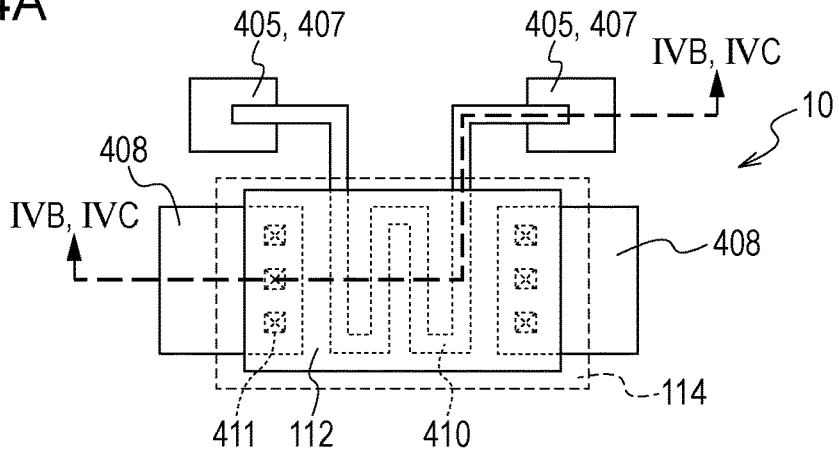
FIGS. 4A to 4C are a plan view and sectional views schematically illustrating the element substrate.
Figure 4B:
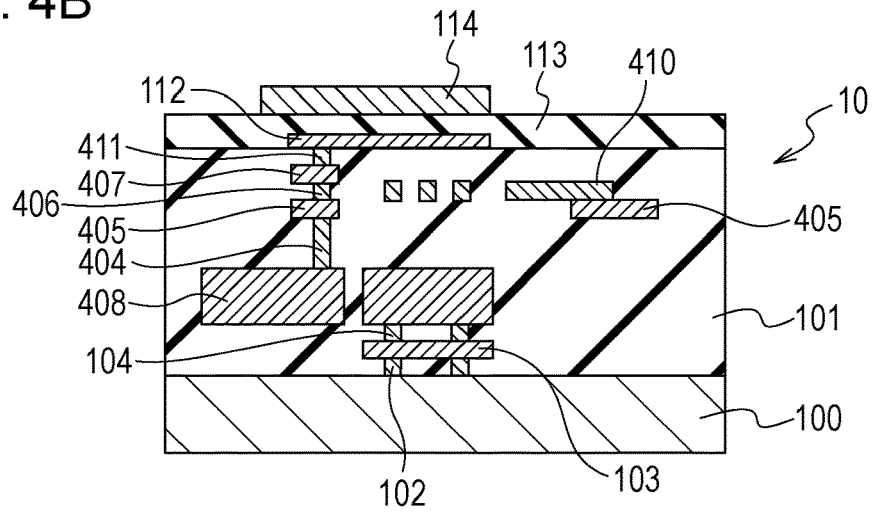

A third embodiment will be described with reference to FIGS. 4A to 4C. FIG. 4A is a schematic plan view illustrating a part of the element substrate 10. FIG. 4B is a schematic sectional view of the element substrate 10 taken along IVB-IVB in FIG. 4A. In the third embodiment, an example of the mode in which sensitivity is enhanced by reducing the thickness of a temperature detection element, which is different from that of the second embodiment, will be described.

Similarly to the first embodiment, the substrate 100, the insulation layer 101, the connection wires 102 and 104, the signal wire 103, the heating resistance element 112, the protective layer 113, and the anti-cavitation layer 114 are arranged.

A power supply wire 408 is arranged on the connection wire 104. Connection wires 404, 406, and 411 and signal wires 405 and 407 are arranged on the power supply wire 408.

A temperature detection element 410 is arranged in a layer between the signal wires 405 and 407, which is the same layer as the connection wire 406. The signal wires 405 and 407 are formed to be thinner than the power supply wire 408 that supplies power to the heating resistance element 112. For example, the signal wires 405 and 407 are formed with a thickness of 100 to 400 nm and the power supply wire 408 is formed with a thickness of 500 to 2000 nm. The lower limit of thickness of each of the connection wires and the temperature detection element 410 that are formed as vias is decided in accordance with the thickness of its lower wire. That is, since each of the connection wires and the temperature detection element 410 is the via formed in the insulation layer 101 covering its lower wire, by reducing the thickness of the lower wire, the thickness of the insulation layer covering the lower wire is able to be reduced and the thickness of the via formed in the insulation layer is also able to be reduced. Thus, by forming the temperature detection element 410 on the signal wire 405 that is thinner than the power supply wire 408, the thickness of the temperature detection element 410 is able to be reduced. In the present embodiment, when the thickness of the signal wires 405 and 407 is 100 to 400 nm, the thickness of the temperature detection element 410 is able to be 100 to 400 nm. Note that, the thickness of the temperature detection element 410 affects detection sensitivity and is thus preferably thin, but the thickness of the temperature detection element 410 is preferably 100 to 2000 nm and more preferably 100 to 400 nm.

In FIG. 4B, the temperature detection element 410 is connected to the signal wire 405 to enable the temperature detection element 410 to perform signal processing.

Figure 4C:
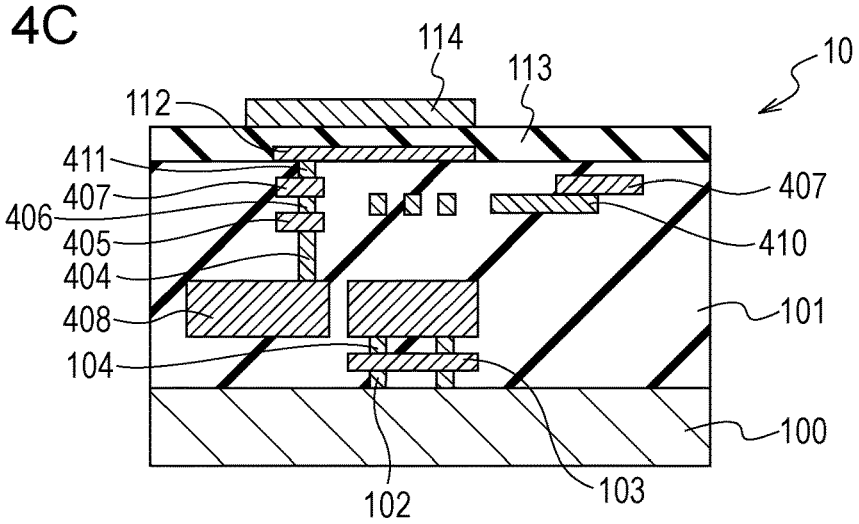

FIG. 4C is a schematic sectional view of the element substrate 10 taken along IVC-IVC in FIG. 4A and illustrates a mode different from that in FIG. 4B. In FIG. 4C, the temperature detection element 410 is connected to the signal wire 407 provided closer to the heating resistance element 112 than the temperature detection element 410 to enable signal processing to be performed. The temperature detection element 410 in FIGS. 4B and 4C is able to be formed by the manufacturing method described in the first embodiment.

Moreover, in the third embodiment, the temperature detection element 410 is formed in the same step as the step of forming the connection wire 406 for electrically connecting the heating resistance element 112 and the power supply wire 408, and accordingly a dedicated mask for forming the temperature detection element 410 is not necessary. Therefore, the third embodiment is able to reduce the number of steps for one mask compared to that in the first embodiment and reduce the number of steps for two masks compared to that in the second embodiment.

As described above, according to the element substrate 10 of the present embodiment, when the thickness of the temperature detection element 410 is reduced, the resistance thereof is able to be further increased while load in a manufacturing process is suppressed. Accordingly, the element substrate 10 that enables sensitivity of temperature detection to be further enhanced is able to be provided.

Fourth Embodiment

Figure 5A:
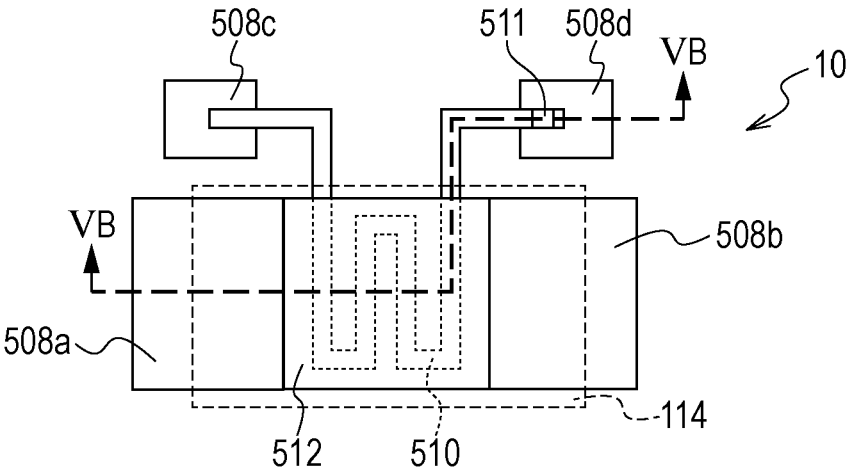
FIGS. 5A and 5B are a plan view and a sectional view schematically illustrating the element substrate.
Figure 5B:
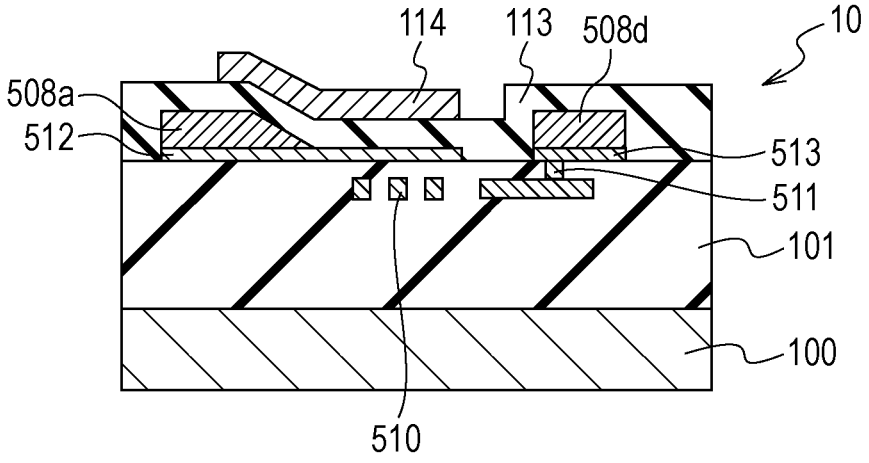

A fourth embodiment will be described with reference to FIGS. 5A and 5B. FIG. 5A is a schematic plan view illustrating a part of the element substrate 10. FIG. 5B is a schematic sectional view of the element substrate 10 taken along VB-VB in FIG. 5A. In the fourth embodiment, an example of a mode in which the number of layers of the wires is minimized will be described.

Similarly to the first embodiment, the substrate 100, the insulation layer 101, the protective layer 113, and the anti-cavitation layer 114 are arranged.

A temperature detection element 510 is arranged in the insulation layer 101. The temperature detection element 510 is able to be formed by the manufacturing method described in the first embodiment. A heating resistance element 512 is arranged on the insulation layer 101. A power supply wire 508 (508*a*, 508*b*) is arranged on the heating resistance element 512. The heating resistance element 512 and the power supply wire 508 may be replaced in the up-down direction. A connection wire 511 is arranged on the temperature detection element 510. The temperature detection element 510 is electrically connected to the power supply wire 508 (508*c*, 508*d*) via the connection wire 511 and a connection wire 513 that is formed in the same layer as the heating resistance element 512 by using the same step and the same material as those of the heating resistance element 512.

As described above, according to the element substrate 10 of the present embodiment, it is possible to provide the element substrate 10 that enables sensitivity of temperature detection by the temperature detection element 510 to be enhanced while further suppressing the load in a manufacturing process.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-140191, filed Jul. 30, 2019 and Japanese Patent Application No. 2020-104702, filed Jun. 17, 2020, which are hereby incorporated by reference herein in their entirety.

What is claimed is:

1. An element substrate having a layered structure comprising:

a heating resistance element (112);

a first insulation layer (101B) where a temperature detection element constituted by a via is formed; and a second insulation layer (101*c*) provided between the heating resistance element and the temperature detection element which electrically insulates the heating resistance element and the temperature detection element, wherein a surface of the temperature detection element on a side of the second insulation layer and a surface of the first insulation layer on a side of the second insulation layer are formed as a same surface.

2. The element substrate according to claim 1, wherein the heating resistance element and the temperature detection element at least partially overlap each other in plan view of the element substrate.

3. The element substrate according to claim 2, wherein, in the temperature detection element, a connection portion with a conductor separate from the via is not formed in a region where the temperature detection element overlaps the heating resistance element.

4. The element substrate according to claim 1, wherein the via is formed in a state where at least a depression provided in the first insulation layer or a through hole passing through the first insulation layer is filled with a metal material.

5. The element substrate according to claim 1, wherein, in the first insulation layer, the via, which is a first via, and a second via that is electrically connected to the heating resistance element are formed of an identical material at an identical position in a layered direction.

6. The element substrate according to claim 5, further comprising a first wire and a second wire that are electrically connected to the heating resistance element and provided in a layered manner, wherein the second via connects the first wire and the second wire by passing through the first insulation layer.

7. The element substrate according to claim 1, further comprising a wire that is electrically connected to the temperature detection element, and a second via that connects the temperature detection element and the wire and is different from the temperature detection element.

8. The element substrate according to claim 1, wherein the via is formed of a material having any of tungsten, aluminum, and copper as a main component.

9. The element substrate according to claim 1, wherein a thickness of the temperature detection element is 100 nm to 2000 nm.

10. A liquid ejection head comprising the element substrate according to claim 1 that ejects liquid by using heat generated by the heating resistance element.

* * * * *